US007703196B2

(12) United States Patent
Chawgo

(10) Patent No.: US 7,703,196 B2
(45) Date of Patent: Apr. 27, 2010

(54) COMPRESSION TOOL LENGTH ADJUSTER

(75) Inventor: Shawn Chawgo, Cicero, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 568 days.

(21) Appl. No.: 11/457,331

(22) Filed: Jul. 13, 2006

(65) Prior Publication Data

US 2008/0010825 A1 Jan. 17, 2008

(51) Int. Cl.
*H01R 43/042* (2006.01)

(52) U.S. Cl. ..... 29/751; 29/753; 29/760; 72/409.14

(58) Field of Classification Search ..... 29/751, 29/753, 760; 72/409.14
See application file for complete search history.

(56) References Cited

U.S. PATENT DOCUMENTS

| | | | | |
|---|---|---|---|---|
| 2,369,180 | A * | 2/1945 | Rosenthal | 29/566 |
| 5,392,508 | A | 2/1995 | Holliday et al. | |
| 5,435,167 | A | 7/1995 | Holliday et al. | |
| 5,647,119 | A | 7/1997 | Bourbeau et al. | |
| 5,934,137 | A | 8/1999 | Tarpill | |
| 5,941,120 | A * | 8/1999 | Jee | 72/409.14 |
| 6,272,738 | B1 | 8/2001 | Holliday et al. | |
| 6,293,004 | B1 | 9/2001 | Holliday | |
| 6,591,487 | B2 | 7/2003 | Chang | |
| 6,594,888 | B2 | 7/2003 | Chang | |
| 6,708,396 | B2 | 3/2004 | Holliday | |
| 6,732,393 | B1 | 5/2004 | Liao | |
| 6,820,326 | B1 | 11/2004 | Tarpill et al. | |
| 6,948,234 | B1 | 9/2005 | Steiner | |
| 7,028,393 | B2 * | 4/2006 | Wei | 29/761 |
| 7,096,573 | B2 * | 8/2006 | Holliday | 29/751 |
| 7,120,997 | B2 * | 10/2006 | Islam et al. | 29/751 |
| 7,210,327 | B1 * | 5/2007 | Tarpill et | 72/409.12 |
| 7,299,542 | B2 * | 11/2007 | Montena | 29/751 |
| 7,346,980 | B2 * | 3/2008 | Liao | 29/758 |
| 2003/0066186 | A1 | 4/2003 | Lu | |
| 2004/0163238 | A1 | 8/2004 | Holliday | |
| 2005/0091841 | A1 | 5/2005 | Liao | |
| 2006/0032048 | A1 | 2/2006 | Liao et al. | |
| 2006/0042346 | A1 | 3/2006 | Holliday et al. | |

* cited by examiner

*Primary Examiner*—C. J Arbes
(74) *Attorney, Agent, or Firm*—Schmeiser, Olsen & Watts, LLP

(57) ABSTRACT

An adjustable driver pin connector compression tool comprising a body that is configured for receiving a plurality of different sized connectors. A sliding head assembly is slidably mounted within the interior of the body. The sliding head assembly being operatively coupled to a driver pin bolt moveable between at least two fixed driver pin positions.

18 Claims, 6 Drawing Sheets

COMPRESSION TOOL LENGTH ADJUSTER

FIELD OF THE INVENTION

The present invention relates to compression tools for attaching connectors onto wires, cables and the like. More particularly, the present invention relates to a compression tool for use with multiple sized connectors and related method of affixing a connector to a cable or wire.

BACKGROUND

The electronics, telecommunications, and cable television industries have used a variety of cables and wires to perform various jobs. Each cable or wire has various size and shaped connectors based upon either an industry standard or in some cases a proprietary manufacturing standard. The industry has used compression tools to attach various sizes and types of connectors onto wires. A common practice has been to use a compression tool having a universal compression head and then attach an appropriate adapter to the tool to couple a connector of a specific length, diameter or other dimension to a corresponding cable.

A universal type of compression tool having an adjustable adapter to vary connector size is known to be compact because it is designed to fit only one connector at a time. Compactness great for ease of handling and storage. Typically, in the early stages of a universal compression tool's life span the universal tool works as intended, but there are many drawbacks as the tool ages. One drawback is that the interchangeable adapters can be lost or damaged. Another drawback is that depending on the design the additional interchangeable and/or movable parts create wear, looseness of the adaptor insert and eventual failure of the universal-type connector compression tool. The instant invention addresses the abovementioned drawbacks of the universal connector compression tool.

SUMMARY OF THE INVENTION

An adjustable driver pin connector compression tool comprising: a body having an interior; a handle, wherein the handle is movably attached to the body; at least one compression chamber portion within the interior of the body that is configured for receiving a connector; a driver pin bolt; and a sliding head assembly slidably mounted within the interior of the body, said sliding head assembly being operatively coupled to the handle, wherein said driver pin bolt is within the sliding head assembly and is moveable between at least two fixed driver pin positions.

An adjustable length compression tool comprising: a body having an interior, a top, a bottom, a first side, a second side, and a retainer portion; a handle, wherein the handle is pivotally attached to the body between the first side and the second side; a toggle lever affixed to the handle; a driver pin; a compression assembly slidably mounted in the retainer portion of the body, wherein said compression assembly includes a driver pin, said driver pin having at least two driver pin positions within the compression assembly, wherein said driver pin is operable to be securely positioned into a gate lock having at least a first driver pin position and a second driver pin position; an compression channel portion positioned within the interior of the body, said compression channel portion configured to receive a first connector when the driver pin assembly is in the first driver pin position, and configured to receive a second connector when the driver pin assembly is in the second driver pin position; and, a cable cradle, wherein said cradle is affixed to the body between the first side and the second side.

A method of affixing a cable connector to a wire comprising: providing an adjustable driver pin connector compression tool comprising a body having an interior, a handle, wherein the handle is movably attached to the body, at least one compression chamber portion within the interior of the body that is configured for receiving a connector, a driver pin bolt, and a sliding head assembly slidably mounted within the interior of the body, said sliding head assembly is operatively coupled to the handle, wherein said driver pin bolt is within the sliding head assembly and is moveable between at least two fixed driver pin positions; providing a cable connector; providing a wire; sliding the driver pin bolt to at least one of the driver tip positions in the body so that the location of the driver pin bolt corresponds to the cable connector; inserting the cable connector and the wire into the adjustable driver pin connector compression tool; moving the sliding head to drive the cable connector onto the wire forming a connector cable; and removing the connector cable from the body.

An adjustable driver pin comprising: a body having an interior; at least one compression chamber portion within the interior of the body, said body being configured for receiving a connector; a compression means positioned within the interior of the body; and a driver pin operatively coupled to the compression means, the driver pin having at least two driver pin positions within the compression means, wherein said driver pin can be twist locked into a driver pin stop having at least a first driver pin position and a second driver pin position.

BRIEF DESCRIPTION OF THE DRAWINGS

The examples shown in the drawings are not intended to limit the scope of the claims and are just one possible manner of assembling the elements of the claimed features. One skilled in the art could prepare many examples that are equivalent in structure and performance to the claimed invention, but that they may differ visually while still performing the same function are still intended to be within the scope of the invention.

DETAILED DESCRIPTION OF THE INVENTION

The problems encountered by a common universal-type compression tool operable with multiple driver tips are addressed by an adjustable driver pin connector compression tool 100 that reduces the risk of unintentional loss of driver pins. The tool 100 comprises a body 10 having an interior 12. The body 10 may be made out of any structurally rigid material, such as stamped steel or an injection molded plastic. The body 10 may be made out of panels that are assembled together to form the tool 100.

Figure 1:
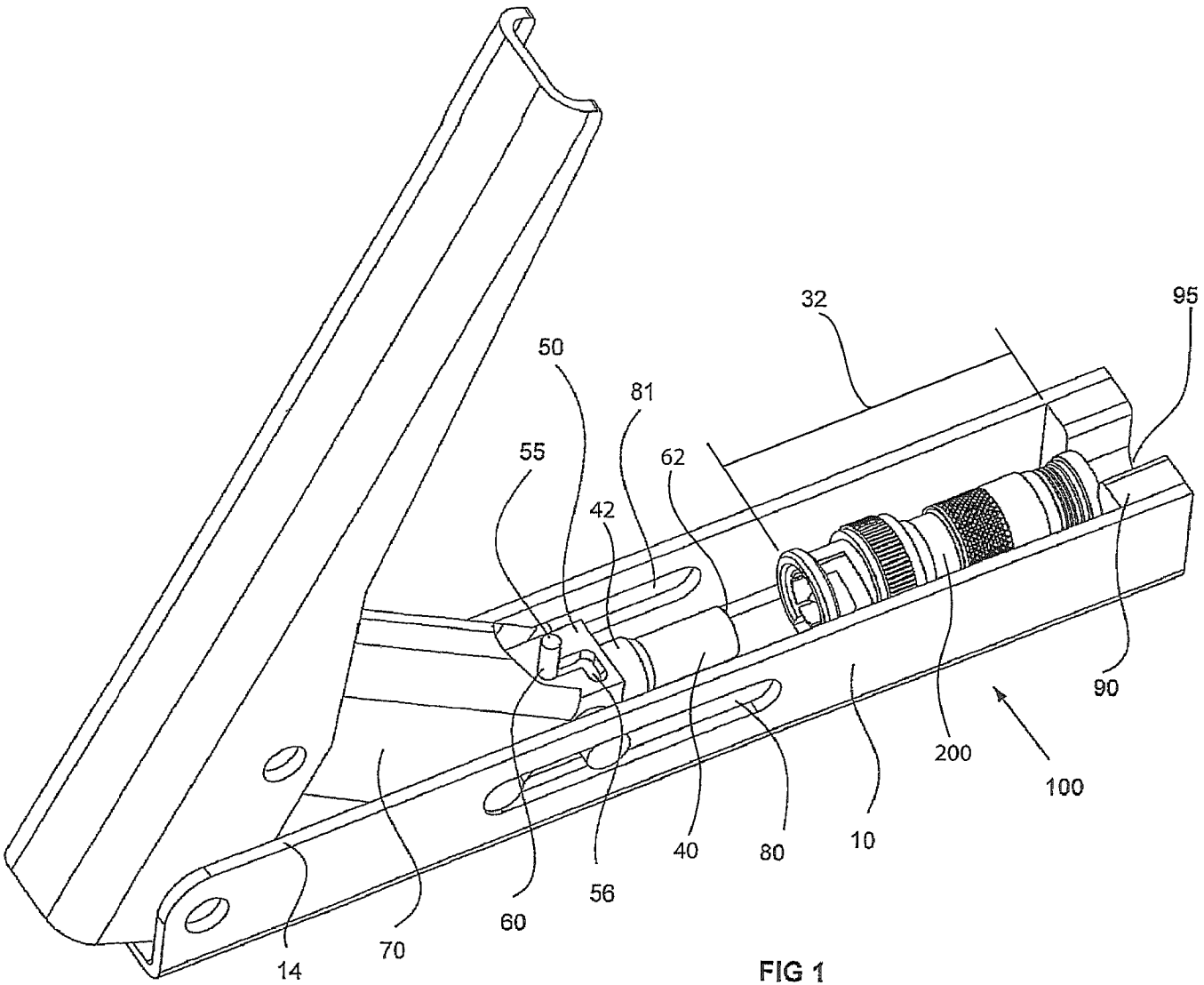
FIG. 1 displays a top perspective view of an embodiment of the tool with the handle raised in a first pin position with a connector in the chamber.
Figure 2:
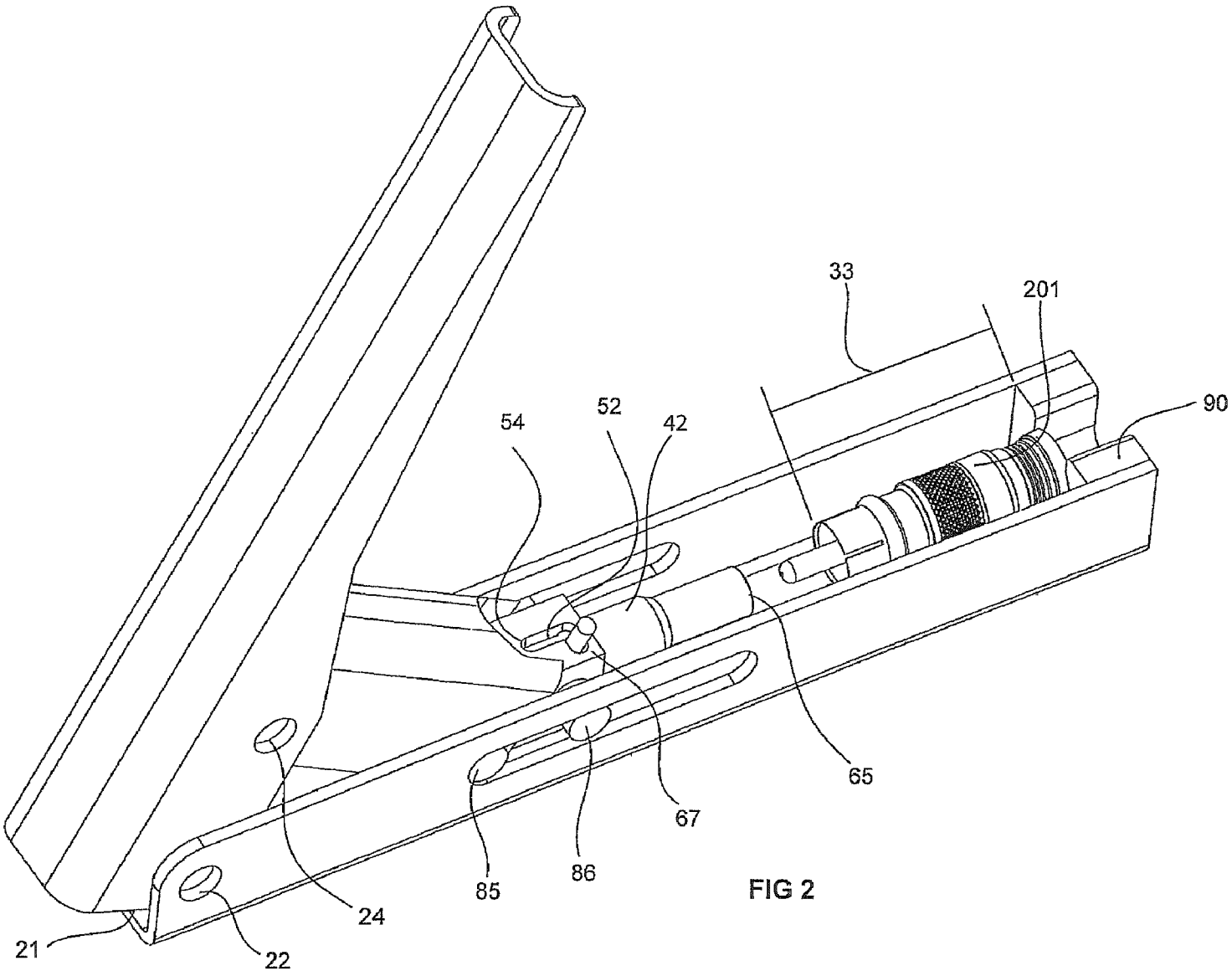
FIG. 2 displays a top perspective view of an embodiment of the tool with the handle raised in a second pin position with a connector in the chamber.
Figure 3:
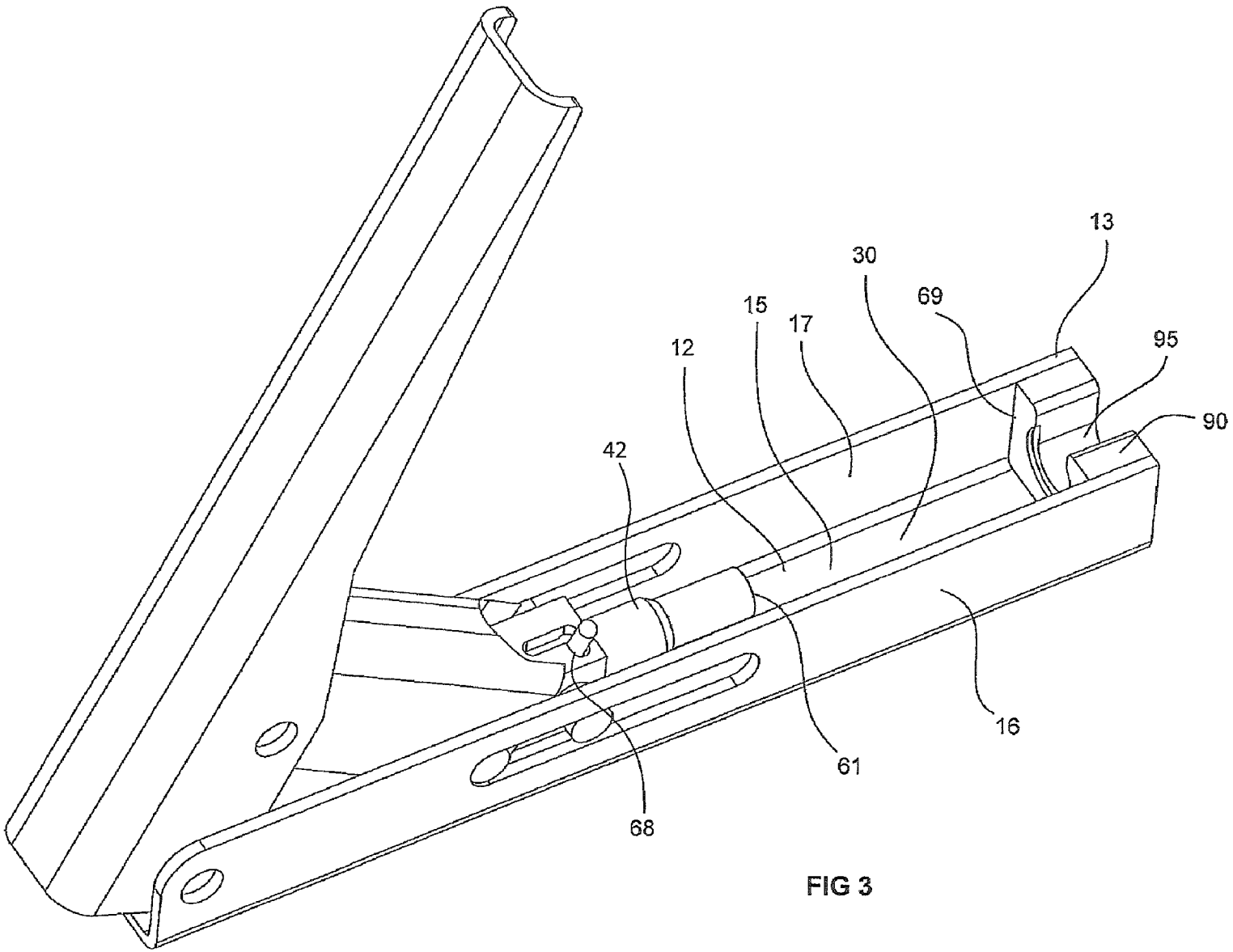
FIG. 3 displays a top perspective view of an embodiment of the tool with the handle raised in a second position.

Attached to the body 10 may be a handle 20, wherein the handle 20 is movably attached to the body 10. Within the body 10 there is at least one compression chamber portion 30 that is configured for receiving a connector 200 as shown in FIGS. 1-3. The compression chamber portion 30 may be, at least in part, defined by the body 10 that surrounds the chamber portion 30 in a box like manner.

A driver pin bolt 42 may be positioned adjacent to the compression chamber portion 30. A sliding head assembly 50 may be slidably mounted within the interior 12 of the body 10, said sliding head 50 assembly being operatively coupled to the handle 20, wherein said driver pin bolt 42 is within the sliding head assembly 50 and is moveable between at least two fixed driver pin positions. The movement of the driver pin bolt 42 may be between two, three, four or more positions that may allow for the compression of an even greater variety of multiple sized connectors 201.

One manner to secure the driver pin 40 is with a protruding component 55 positioned on the driver pin bolt 42, said protruding component 55 being configured to interact with the sliding head assembly 50. The sliding head assembly 50 may have a receiving portion 52 configured to accept the protruding component 55 of the driver pin bolt 42. The driver pin bolt 42 may be moved into a first driver pin bolt position 62 as shown in FIG. 1. A first protruding component locked position 60, defined by the position of the protruding component 55, may correspond to the first driver pin bolt position 62. The protruding component 55 may be locked so that there is no chance of unintended movement of the driver pin 40 causing incomplete compression of the connector 200. If the protruding component 55 were not in a locked position, such as possible when the driver pin bolt 42 may only be threaded to adjust driver pin 40 position, and thus having no fixed pin positions causing problems with connector 200 compression.

The driver pin bolt 42 may be moved to a second driver pin bolt position 67 as shown in FIG. 2. A second protruding component locked position 65 may correspond to a second driver pin bolt position 67 and may be used to change the effective driver pin length. The second driver pin bolt position 67 may allow for compression of at least a second connector 201 onto a wire 202 without requiring changing of a driver pin insert adaptor.

Optionally a toggle lever 70 may be hingedly affixed between the handle 20 and the sliding head assembly 50. The addition of the toggle lever 70 between the handle 20 and the sliding head assembly 50 may allow for a more linear application of force between the handle 20 and the sliding head assembly 50. When the handle 20 is attached directly to the sliding head 50 without the inclusion of the toggle lever 70, tool 100 operation may require a higher amount of force to compress a connector 200. The toggle lever 70 should be relatively stiff and should not flex or buckle during the application of force through the handle 20 required to compress a connector 200 onto a wire 202.

The protruding component 55 may be a tab, may be a projection, or may be defined as a cylinder, rod or tube that may be permanently or removably affixed to the rod bolt 42. On the protruding component 55 may optionally be a driver pin locking tab 68 operably associated with the first and second driver pin positions 62, 67. The locking tab 68 may be an additional locking feature such as a notch, depression, or groove that would be in contact with a first tab stop receiver 54 on the sliding head assembly 50 when the pin bolt 42 is in the first driver pin position 62. The locking tab feature 68 may add a tactile feel such as a click or snap when engaged fully. Furthermore, a second tab stop receiver 56 on the sliding head assembly 50 may interact with the driver pin locking tab 68 when moved into the second driver pin position 67. The driver pin locking tab 68 may add further protection from unintentional movement of the protruding component 55. The driver pin position 62, 67 is the length of the pin tip from the sliding head 50.

The tool 100 may be adjustable in that it may allow for the compression of different sized connectors 201. If a connector 201 was attempted to be compressed onto a cable through operation with an incorrectly sized chamber then the tool 100 may either fail to perform as intended and have the connector 200 fall off of the wire 202 if the chamber was too large or may break or over-compress the connector 201 if the chamber was too small. Therefore, a compression channel portion 30 may be operably defined as substantially the distance from the end of the driver tip 61 to the end wall 69 formed by the body 10. Therefore, a connector compression tool 100 may include a first compression channel portion 32 of the body 10 for receiving a connector of a first dimension 200, said first compression channel 32 being configured when the driver pin bolt 42 is locked in a first driver pin position 62. Furthermore, a connector compression tool 100 may include a second compression channel portion 33 of the body 10 for receiving a connector of a second dimension 201, said second compression channel 33 being configured when the driver pin bolt 42 is locked in a second driver pin position 67. Optionally at the end of the compression chamber 30 may be a cable receiver 90 mounted either within the interior 12, or at the end 13 of the body 10.

A guide portion 80 may be on the body 10 and may help to align, position and/or retain the sliding head 50 within the interior 12 within the body 10 of the tool 100. The guide portion 80 could be a groove, depression, trough, slot or notch that may or may not create an opening within the body 10. A guide protrusion 85, 86 may be affixed on the sliding head 50, wherein the guide protrusion 85, 86 is slidably mounted within the guide portion 80 of the body 10. Alternatively, the guide portion 80 could be placed on the sliding head 50 and the protrusion 85 be mounted on the body 10. Other embodiments may include guide portions 80 on both the sliding head 50 and the body 10 and in place of the protrusion 85 would be a ball or sphere such as a bearing that may be partially enclosed in both guide portions 80 to allow the sliding movement of the sliding head 50.

Another embodiment of an adjustable length compression tool 100 may comprise a body 10 having an interior 12, a top 14, a bottom 15, a first side 16, a second side 17, and a retainer portion 80. The body 10 may be any material that is sufficiently rigid enough to compress the connector 200, 201 onto a wire 202 without substantial distorting or flexing. The body 10 may be a material such as a metal that could be shaped from a single piece or assembled from stamped or cut pieces that may be either fastened or welded together or made of plastic that is injection molded into a single piece or assemble from separate pieces.

The compression tool has a means for compressing the connector 200, 201 on to a cable 202, wherein the means may include a handle 20, wherein the handle 20 may be pivotally attached to the body 10 between the first side 16 and the second side 17. An alternative means of compressing the connector 200, 201 onto the wire 202 may be a hydraulic piston, a crank turning a threaded shaft, a motor or pneumatic pressure. The handle 20 may be hingedly attached at the base 21 to the body 10 with a protrusion or hinge 22. Means for compressing may also include the handle 20 may also be hingedly attached to a toggle lever 70 about 20-50% of the handle 20 away from the base 21 with a hinge 24 to hingedly affixed to the sliding head 50 with protrusion 86.

Figure 4:
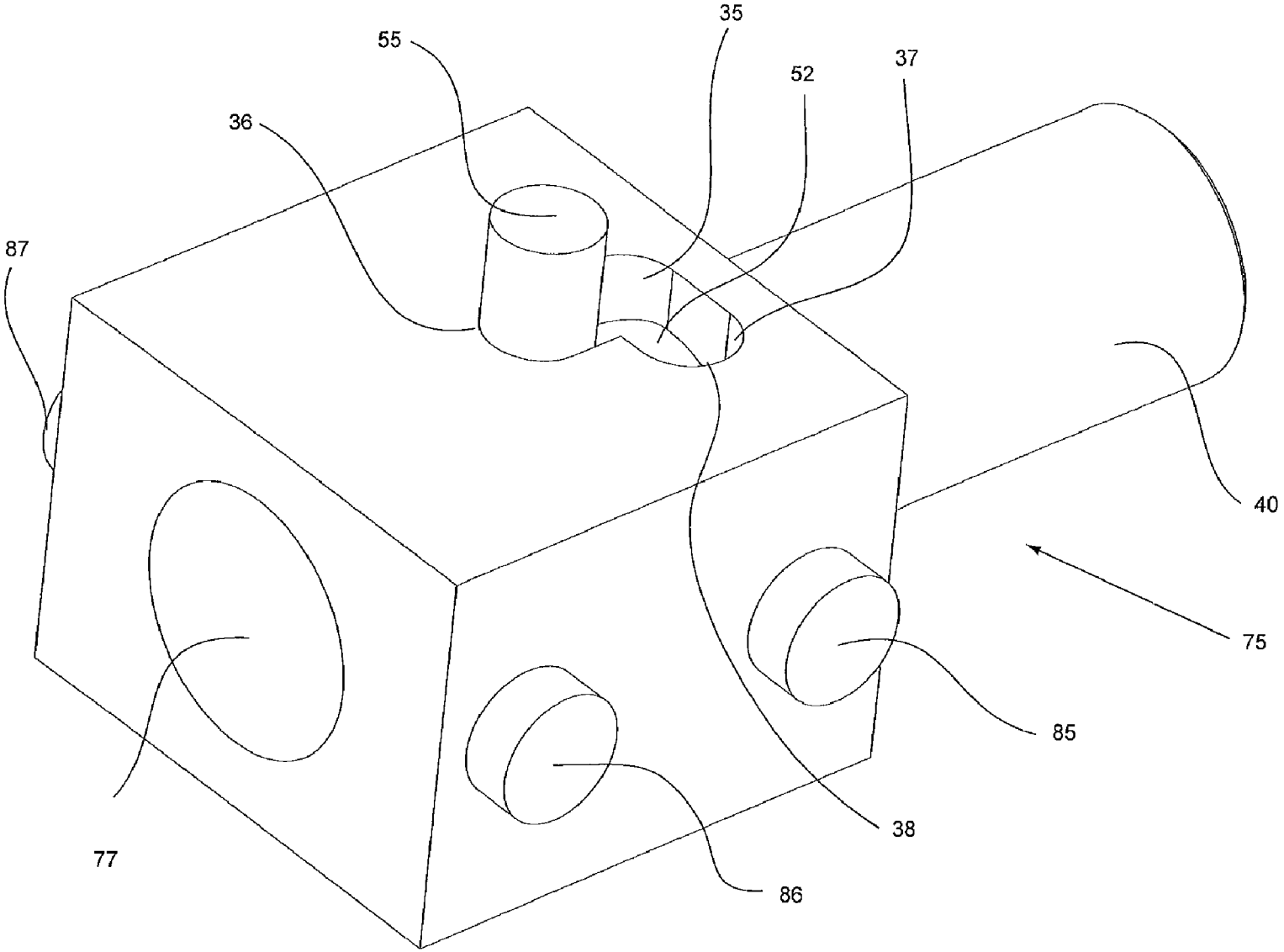
FIG. 4 displays a top perspective view of an embodiment of the pin assembly of an embodiment of the tool.
Figure 5:
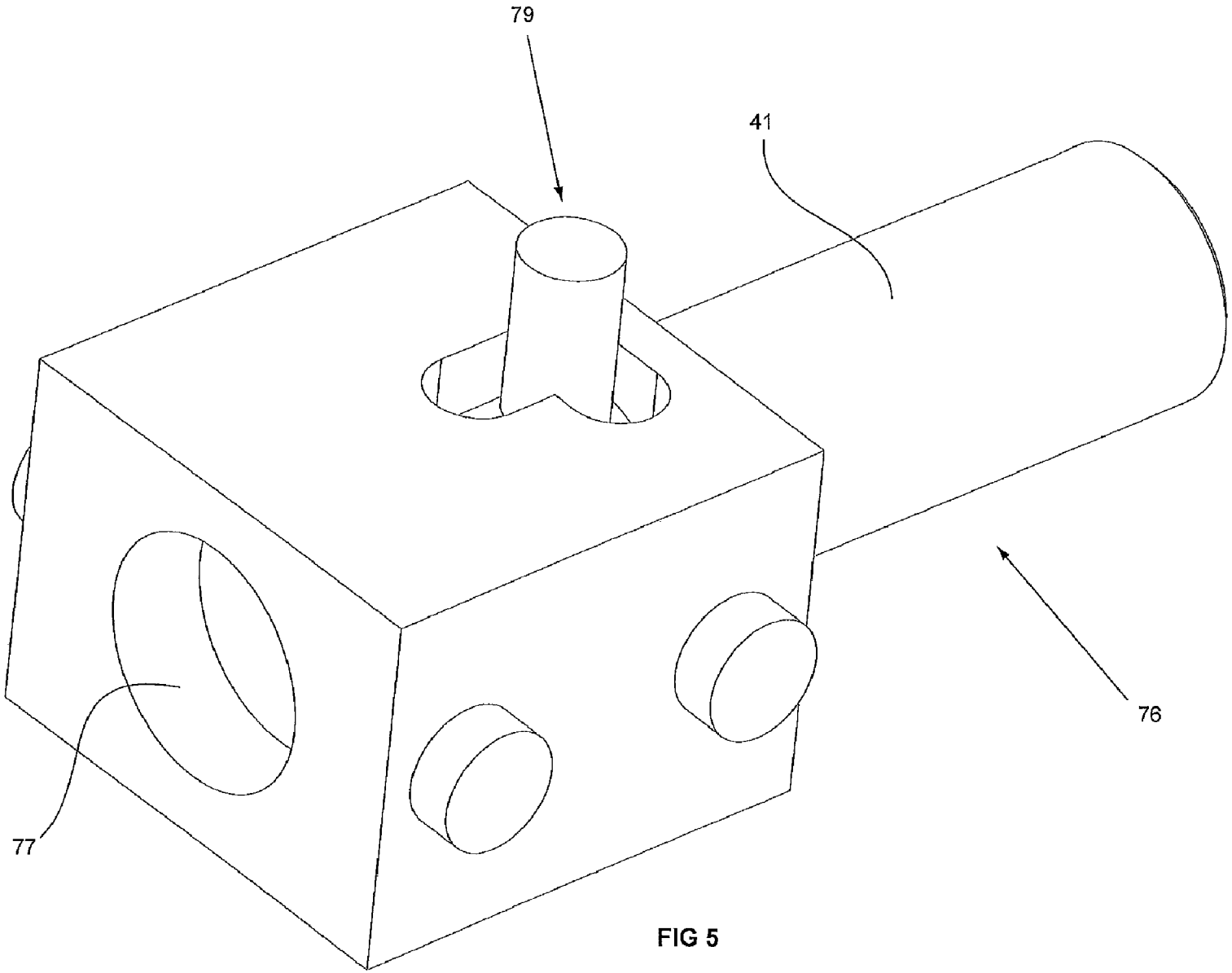
FIG. 5 displays a top perspective view of an embodiment of the pin assembly between positions of an embodiment of the tool.

The compression of the connector 200, 201 onto the wire 202 is facilitated with the use of a driver pin 40. FIGS. 4 and 5 shows a compression assembly 75 that may be slidably mounted in the retainer portion 80 of the body 10, wherein said compression assembly 75 includes a driver pin 40, said driver pin 40 having at least two driver pin positions 36, 37 within the compression assembly 75. The driver pin 40 may be securely positioned into a gate lock 35 having at least a first driver pin position 36 and a second driver pin position 37.

The connector and wire may be placed into a compression channel portion 30 within the interior 12 of the body 10 when the handle 20 is in the raised position. The compression channel portion 30 may be configured to receive a first connector 200 when the driver pin assembly 75 or compression assembly 75 is in the first driver pin position 60, 36 and configured to receive a second connector 201 when the driver pin assembly 75 is in the second driver pin position 65, 37.

A cable cradle 90 may be positioned at the opposite end of the compression channel portion 30 from the end of the driver tip 61. The cable cradle 90 may have a notch 95 that is substantially "U" shaped or may at least have an opening with a width larger than a cable 200, but less than the width of the connector 200, 201, wherein said cradle 90 may be affixed to the body 10 between the first side 16 and the second side 17. The connector 200, 201 may be held stationary and in alignment by the cable cradle 90.

A protruding component 85, 86, 87, 88 may be affixed to the compression assembly 75 to slidably mount the compression assembly 75 in the retainer portion 80, 81 of the body 10. The positioning of the protruding components 85, 86, 87, 88 may be on both sides of the compression assembly 75 that slidably moves respectively in the retainer portion 80, 81 and may help to stabilize the movement of the compression assembly 75 during the attachment of the connector 200, 201 onto the cable 202.

The compression assembly 75 may have at least two different driver pin positions that may allow for different sized connectors 200, 201 to be compressed onto the wire 202. A tab 55 may be mounted on the driver pin 40 to facilitate more precise positioning of the driver pin 40. A receiving portion 52 of the compression assembly 75 accepts the tab 55 that is slidably positioned therein. The receiving portion 52 of the compression assembly 75 may be a channel or open groove machined out and the gate lock 35 may comprise a stop formed by the tab 55 contacting an edge 38 of the channel 52 that is perpendicular to the centerline of the driver pin 40 so that movement of the pin 40 is arrested during compression of the connector 200, 201.

The connectors 200, 201 need to be compressed a certain amount to form a good cable otherwise failure of the cable 203 may occur. A first compressed length 32 may correspond to the compression channel portion 30 of the tool 100 when the driver pin 40 is in the first driver tip position 60, such as shown in FIG. 1 with connector 200. A second compressed length 33 may correspond to the compression channel portion 30 of the tool 100 when the driver pin 40 is in the second driver tip position 65, such as shown in FIG. 2 with connector 201.

Figure 6:
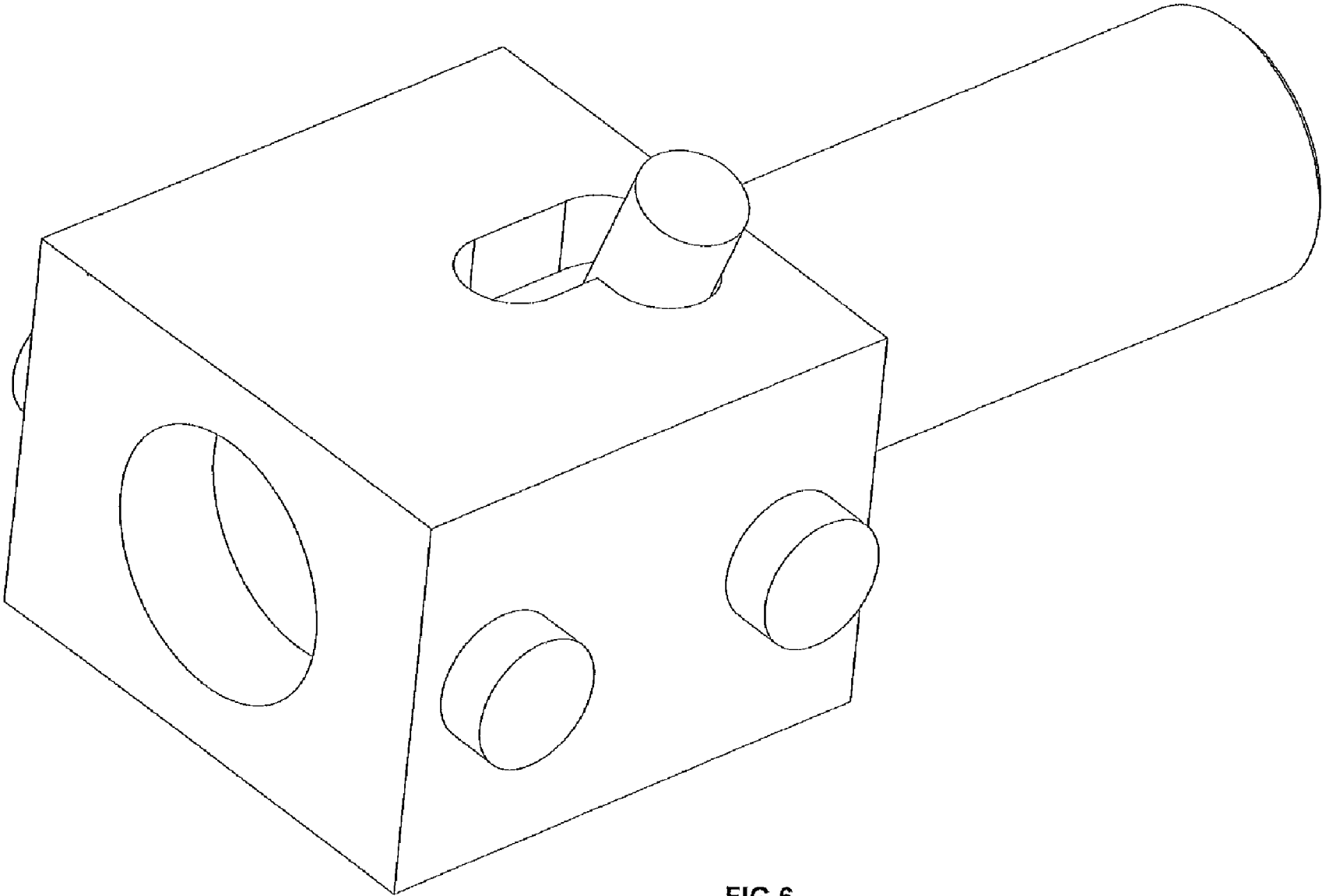
FIG. 6 displays a top perspective view of an embodiment of a pin assembly of an embodiment of the tool.

The tool 100 may need to compress onto a cable 203 an unusually dimensioned connector that may not be adjustable within the limits of the tool to properly fit the desired connector 200. The compression assembly 75 may be swapped with a different unit as shown in FIGS. 4-6 to address this concern. The currently installed driver pin 40 may be swapped to address the compression of a specific connector 200 having a requirement for a different length or a requirement for a different driver tip 40, 41 diameter than was typically encountered. A compression assembly 75 may allow for the replacement of the driver tip unit 40, said driver tip unit 40 being removably affixed.

If the driver pin 40 is permanently affixed to the compression assembly 75, then the compression assembly 75 may be exchanged with a second compression assembly 76 with a second driver tip unit 79. The second compression assembly 76 having a driver tip unit 79 that may have a driver pin 41 with either a different length or diameter. The whole compression assembly 75 may be exchanged, or just the driver pin 40, 41 could be exchanged as addressed above. FIGS. 1-3 shows a driver pin 40 having a first diameter and a first length. Whereas, FIGS. 4-6 show a driver pin 41 having a second diameter and driver pin 79 with a second length. The driver pin 40, 41 may be releasably retained in the sliding head 50 or driver tip unit 75 by the tab 55 being screwed into the side of the body of the driver pin 40, 41 through the gate or channel 52, and unscrewed to be released.

The driver pin 40 is slidably received by the compression assembly 75. The compression assembly 75, 76 or slidable head 50 may be formed from either a solid or a hollow cube of material where a hole 77 is produced through the approximate center of the cube. The hole 77 may have a diameter slightly larger than the greatest diameter pin to allow a slidable fit that is not loose, as shown in FIGS. 1-5. FIGS. 1-3 show a smaller diameter pin 40 having a larger base or bolt 42. The groove 52 may be machined or molded into the cube either before or after the introduction of the hole 77, wherein the groove 52 may create an opening that intersects with the hole 77. The desired driver tip 40, 41 may be inserted into the hole 77 in the cube. The tab or protrusion 55 may then inserted into driver tip 41, 42, which may serve two purposes, to retain the drivers tip 41, 42 within the sliding head 50 or compression assembly 75 and/or to adjust and lock the position of the tip 62, 67.

A method of affixing a cable connector 200, 201 to a wire 202 comprises providing an adjustable driver pin connector compression tool 100 comprising a body 10 having an interior 12, a handle 20, wherein the handle 20 is movably attached to the body 10, at least one compression chamber portion 30 within the interior 12 of the body 10 that is configured for receiving a connector 200, 201, a driver pin bolt 40, and a sliding head assembly 50 slidably mounted within the interior of the body 10, said sliding head assembly 50 being operatively coupled to the handle 20, wherein said driver pin bolt 42 is within the sliding head assembly 50 and is moveable between at least two fixed driver pin positions. Along with the provision of the tool, additional methodology may include providing a cable connector and providing a wire. The tool 100, may be adjusted by sliding the driver pin bolt 42 to at least one of the driver tip positions 62, 67 in the body 10 so that the location of the driver pin bolt 42 corresponds to the cable connector 200, 201. Moreover, additional methodology may include inserting the cable connector and the wire into the adjustable driver pin connector compression tool 100. Still further methodology may include compressing the connector 200, 201 onto the cable 202 by moving the sliding head 50 to drive the cable connector 200, 201 onto the wire 202 forming a connector cable 203 before removing the connector cable 202 from the body 10.

Another embodiment is an adjustable driver pin compression tool 100 comprising a body 10 having an interior 12. The tool 100 may have at least one compression chamber portion 30 within the interior of the body 12, said body 10 being configured for receiving a connector 200, 201.

To attach the connector 200, 201 onto the wire 203 a compression means may be positioned within the interior of the body 10. The compression means discussed supra may include compression with a handle 20 moving a sliding head 50; or with the handle 20 that transfers force through a toggle lever 70 to the move the sliding head 50; or through a crank that turns a threaded shaft to move the sliding head forward with the shaft; or may operate with a hydraulic piston; or a pneumatic piston; or a motor; or electric motor or other equivalent manners to move either the sliding head 50 or a driver pin 40 to compress the connector 200, 201 onto the wire 203.

A driver pin 40 may be operatively coupled to the compression means, the driver pin 40 having at least two driver pin positions within the compression means, wherein said driver pin 40 can be twist locked into a driver pin stop 54, 56 having at least a first driver pin position 60 and a second driver pin position 65. Twist locked refers to the rotation of the driver pin 40, which may be cylindrical, within the hole 77 within the compression assembly 75, 76 or the sliding head 50 that may allow for rotation of the driver pin 40 in certain position, as shown in FIG. 6. The driver pin 40 may be locked by twisting the driver pin 40 into a locked position 36, 37 as shown in FIG. 4.

Various modifications and variations of the described apparatus and methods of the invention will be apparent to those skilled in the art without departing from the scope and spirit of the invention. Although the invention has been described in connection with specific embodiments, outlined above, it should be understood that the invention should not be unduly limited to such specific embodiments. Various changes may be made without departing from the spirit and scope of the invention as defined in the following claims.

I claim:

1. An adjustable driver pin connector compression tool comprising:

a body having an interior;

a handle, wherein the handle is movably attached to the body;

at least one compression chamber portion within the interior of the body that is configured for receiving a connector;

a driver pin bolt; and a sliding head assembly slidably mounted within the interior of the body, said sliding head assembly being operatively coupled to the handle, wherein said driver pin bolt is within the sliding head assembly and is moveable within the sliding head assembly, so as to be moved between at least two fixed driver pin positions.

2. The tool of claim 1 further comprising:

a protruding component positioned on the driver pin bolt, said protruding component configured to interact with the sliding head assembly; and, a receiving portion within the sliding head assembly, said receiving portion configured to accept the protruding component of the driver pin bolt.

3. The tool of claim 2 further comprising:

a first driver pin attached to the driver pin bolt:

a first driver pin bolt position being a first fixed position of the at least two fixed driver pin positions; and a first protruding component locked position that corresponds to the first driver pin bolt position.

4. The tool of claim 2 further comprising:

a second driver pin attached to the driver pin bolt:

a second driver in position being a second fixed position of the at least two fixed driver pin positions; and a second protruding component locked position that corresponds to the second driver pin bolt position.

5. The tool of claim 1 further comprising:

a toggle lever affixed between the handle and the sliding head assembly.

6. The tool of claim 1 further comprising:

a driver pin locking tab associated with a first driver pin position; and a first tab stop receiver on the sliding head assembly.

7. The tool of claim 1 further comprising:

a first compression channel portion of the body for receiving a connector of a first dimension, said first compression channel configured when the driver pin bolt is locked in a first driver pin position.

8. The tool of claim 1 further comprising:

a second compression channel portion of the body for receiving a connector of a second dimension, said second compression channel configured when the driver pin bolt is locked in a second driver pin position.

9. The tool of claim 1 further comprising:

a guide portion on the body;

a guide protrusion on the sliding head, wherein the guide protrusion is slidably mounted within the guide portion of the body.

10. The tool of claim 1 further comprising:

a cable receiver mounted within the interior of the body.

11. An adjustable length compression tool comprising:

a body having an interior, a top, a bottom, a first side, a second side, and a retainer portion;

a handle, wherein the handle is pivotally attached to the body between the first side and the second side;

a toggle lever affixed to the handle;

a driver pin;

a compression assembly slidably mounted in the retainer portion of the body, wherein said compression assembly includes a driver pin, said driver pin having at least two driver pin positions within the compression assembly, wherein said driver pin is operable to be securely positioned into a gate lock having at least a first driver pin position and a second driver pin position;

an compression channel portion positioned within the interior of the body, said compression channel portion configured to receive a first connector when the driver pin assembly is in the first driver pin position, and configured to receive a second connector when the driver pin assembly is in the second driver pin position; and, a cable cradle, wherein said cradle is affixed to the body between the first side and the second side.

12. The tool of claim 11 further comprising:

a protruding component affixed to the compression assembly to slidably mount the compression assembly in the retainer portion of the body.

13. The tool of claim 11 further comprising:

a tab mounted on the driver pin; and a receiving portion of the compression assembly wherein said tab is slidably positioned therein.

14. The tool of claim 11 further comprising:

a driver tip unit, said driver tip unit removably affixed within the compression channel for exchange with a second driver tip unit.

15. The tool of claim 11 further comprising:

a first compressed length that corresponds to the compression channel portion of the head when the driver pin is in the first driver tip position.

16. The tool of claim 11 further comprising:

a second compressed length that corresponds to the compression channel portion of the head when the driver pin is in the second driver tip position.

17. The tool of claim 14 wherein the receiving portion of the compression assembly is a channel and the gate lock comprises a stop formed by the tab contacting an edge of the channel that is perpendicular to the centerline of the driver pin.

18. An adjustable driver pin compression tool comprising:

a body having an interior;

at least one compression chamber portion within the interior of the body, said body being configured for receiving a connector;

a compression means positioned within the interior of the body; and a driver pin operatively coupled to the compression means, the driver pin having at least two driver pin positions within the compression means, wherein said driver pin can be twist locked into a driver pin stop having at least a first driver pin position and a second driver pin position.

* * * * *

UNITED STATES PATENT AND TRADEMARK OFFICE

CERTIFICATE OF CORRECTION

PATENT NO. : 7,703,196 B2
APPLICATION NO. : 11/457331
DATED : April 27, 2010
INVENTOR(S) : Chawgo It is certified that error appears in the above-identified patent and that said Letters Patent is hereby corrected as shown below:

Column 10

Line 1, delete "14" and insert -- 13 --

Signed and Sealed this

Fifteenth Day of June, 2010

David J. Kappos

David J. Kappos
*Director of the United States Patent and Trademark Office*